US010729957B2

(12) United States Patent
Chambert

(10) Patent No.: US 10,729,957 B2
(45) Date of Patent: Aug. 4, 2020

(54) RECOVERY MATERIALS FOR CORE CONSTRUCTS AND METHODS FOR REPAIRING CORE CONSTRUCTS

(71) Applicant: Bauer Hockey Ltd., Blainville (CA)

(72) Inventor: Martin Chambert, Piedmont (CA)

(73) Assignee: Bauer Hockey, LLC, Exeter, NH (US)

( * ) Notice: Subject to any disclaimer, the term of this patent is extended or adjusted under 35 U.S.C. 154(b) by 0 days.

(21) Appl. No.: 16/037,717

(22) Filed: Jul. 17, 2018

(65) Prior Publication Data

US 2018/0318682 A1 Nov. 8, 2018

Related U.S. Application Data

(62) Division of application No. 15/235,206, filed on Aug. 12, 2016.

(51) Int. Cl.
*A63B 60/42* (2015.01)
*A63B 59/70* (2015.01)
(Continued)

(52) U.S. Cl.
CPC ..... *A63B 60/42* (2015.10); *A63B 59/70* (2015.10); *A63B 60/54* (2015.10);
(Continued)

(58) Field of Classification Search
CPC ..... B32B 43/00; B32B 23/02
See application file for complete search history.

(56) References Cited

U.S. PATENT DOCUMENTS 5,217,221 A * 6/1993 Baum ..... B27D 1/08 473/561
5,558,326 A * 9/1996 Adamson ..... B29C 61/0608 473/563

(Continued)

FOREIGN PATENT DOCUMENTS

WO 9700275 A2 1/1997
WO 2006071814 A2 7/2006

OTHER PUBLICATIONS

Nov. 30, 2017—(WO) International Search Report and Written Opinion—App PCT/US2017-046141.
Dec. 17, 2019—(CA) Examiner's Report App 3033353.

*Primary Examiner* — Eugene L Kim
*Assistant Examiner* — Christopher Glenn
(74) *Attorney, Agent, or Firm* — Banner & Witcoff, Ltd.

(57) ABSTRACT

A sporting implement, such as a blade for a hockey stick, may include an outer layer, a core, and a recovery gel positioned between the core and the outer layer. The recovery gel can form a film, and the recovery gel can be compressible, shape recoverable, and pressurized to a predetermined pressure. The recovery gel can be configured to provide an integrated agent for filling cracks that appear during use of the blade. The recovery gel can be configured to absorb energy impacts between the outer layer and the core. When a crack appears, the predetermined pressure can be relieved inside the crack and fills a cavity formed by the crack to provide cohesion between the outer layer and the core to recreate a new material in the place of the crack. The recovery gel can be configured to help prevent cracks from propagating and actively heals potential damages by reducing stiffness loss caused by cracks.

9 Claims, 7 Drawing Sheets

(51) Int. Cl.

| | |
|---|---|
| ***A63B 60/54*** | (2015.01) |
| ***A63B 69/00*** | (2006.01) |
| ***A63B 71/08*** | (2006.01) |
| ***A63B 53/00*** | (2015.01) |
| ***A63B 59/00*** | (2015.01) |
| ***A63B 60/00*** | (2015.01) |

(52) U.S. Cl.

CPC ..... *A63B 69/0026* (2013.01); *A63B 53/00* (2013.01); *A63B 59/00* (2013.01); *A63B 60/00* (2015.10); *A63B 71/08* (2013.01); *A63B 2209/02* (2013.01); *A63B 2225/30* (2013.01)

(56) References Cited

U.S. PATENT DOCUMENTS 5,943,767 A * 8/1999 Milam ..... A63B 53/02 29/800
6,794,472 B2 9/2004 Harris et al.
7,963,868 B2 6/2011 McGrath et al.
9,289,662 B2 3/2016 Gans
9,295,890 B2 3/2016 Gans
9,364,988 B2 6/2016 Maia et al.
2001/0005699 A1 6/2001 Morgan et al.
2001/0041633 A1* 11/2001 Tiitola ..... A63B 59/70 473/560
2003/0032758 A1* 2/2003 Harris ..... A63B 37/0003 528/62
2004/0087394 A1* 5/2004 Byers ..... B05D 5/02 473/560
2005/0176529 A1* 8/2005 Frischmon ..... B27M 3/22 473/560
2007/0062630 A1* 3/2007 Wilbur ..... A63B 60/42 156/94
2009/0233053 A1* 9/2009 Gans ..... B29C 70/021 428/192
2011/0014996 A1 1/2011 Shepherd et al.
2012/0070301 A1* 3/2012 Gans ..... B29C 70/24 416/229 R
2012/0142460 A1* 6/2012 Mollner ..... A63B 60/52 473/561
2015/0021818 A1 1/2015 Gans
2015/0246274 A1 9/2015 Xun et al.

* cited by examiner

RECOVERY MATERIALS FOR CORE CONSTRUCTS AND METHODS FOR REPAIRING CORE CONSTRUCTS

CROSS-REFERENCE TO RELATED APPLICATIONS

This application is a divisional of U.S. patent application Ser. No. 15/235,206, filed Aug. 12, 2016, which is incorporated herein by reference in its entirety for any and all non-limiting purposes.

FIELD

This disclosure relates generally to fabrication of molded structures. More particularly, aspects of this disclosure relate to core structures formed with a recovery material. The recovery material can be configured to repair cracks that form in an internal core.

BACKGROUND

Certain sporting implements may be formed with a central portion or a core. For example, a hockey stick blade can be formed of a core reinforced with one or more layers of synthetic materials such as fiberglass, carbon fiber or Aramid. Cores of hockey stick blades may also be made of a synthetic material reinforced with layers of fibers. The layers may be made of a woven filament fiber, preimpregnated with resin. These structures may include a foam core with a piece of fiber on the front face of the blade and a second piece of fiber on the rear face of the blade, in the manner of pieces of bread in a sandwich.

Cores of sporting implements may be subject to cracking or breaking over time. For example, a hockey stick blade core may crack during its normal use during play. This can induce a softening of the product, and may eventually lead to a break of the blade or stick. Nevertheless, adding a significant amount of material may increase the weight of the blade and stick, and the use of softer core materials may lead to breakage of the outer layer of the sporting implement because of the amount of movement of the outer layer allowed by the core. In the case of a hockey stick blade, this may also create a "trampoline effect" that may make the puck bounce off of the blade that is more than desired. Also the use of a harder material for the core, may in certain instances, be either be too fragile or too heavy. Moreover, omitting the foam core in a hockey stick blade may create a different "feel" of the stick to the player because of the lack of damping.

SUMMARY

The following presents a general summary of aspects of the disclosure in order to provide a basic understanding of the invention and various features of it. This summary is not intended to limit the scope of the invention in any way, but it simply provides a general overview and context for the more detailed description that follows.

Aspects of this disclosure relate to reducing the amount of cracks in a core material by absorbing energy between the outer layer, which can be a carbon skin, and the core material. If cracks form in the core, a layer of material can be configured to fill the cracks and to reduce the stiffness losses in the core. This may help to allow for more consistency during use of the sporting implement and allow the sporting implement to be used for a longer period of time.

Other objects and features of the disclosure will become apparent by reference to the following description and drawings.

BRIEF DESCRIPTION OF THE DRAWINGS

A more complete understanding of the present disclosure and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration of various structures in accordance with the invention. Additionally, it is to be understood that other specific arrangements of parts and structures may be utilized, and structural and functional modifications may be made without departing from the scope of the present invention.

Also, while the terms "top" and "bottom" and the like may be used in this specification to describe various example features and elements of the disclosure, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

In general, as described above, aspects of this disclosure relate to the repair of a core structure. More specifically, aspects of the disclosure pertain to a recovery gel that can be used in conjunction with a sporting implement and methods for repairing a sporting implement, such as a hockey stick blade. More detailed descriptions of aspects of the disclosure follow.

Figure 1:
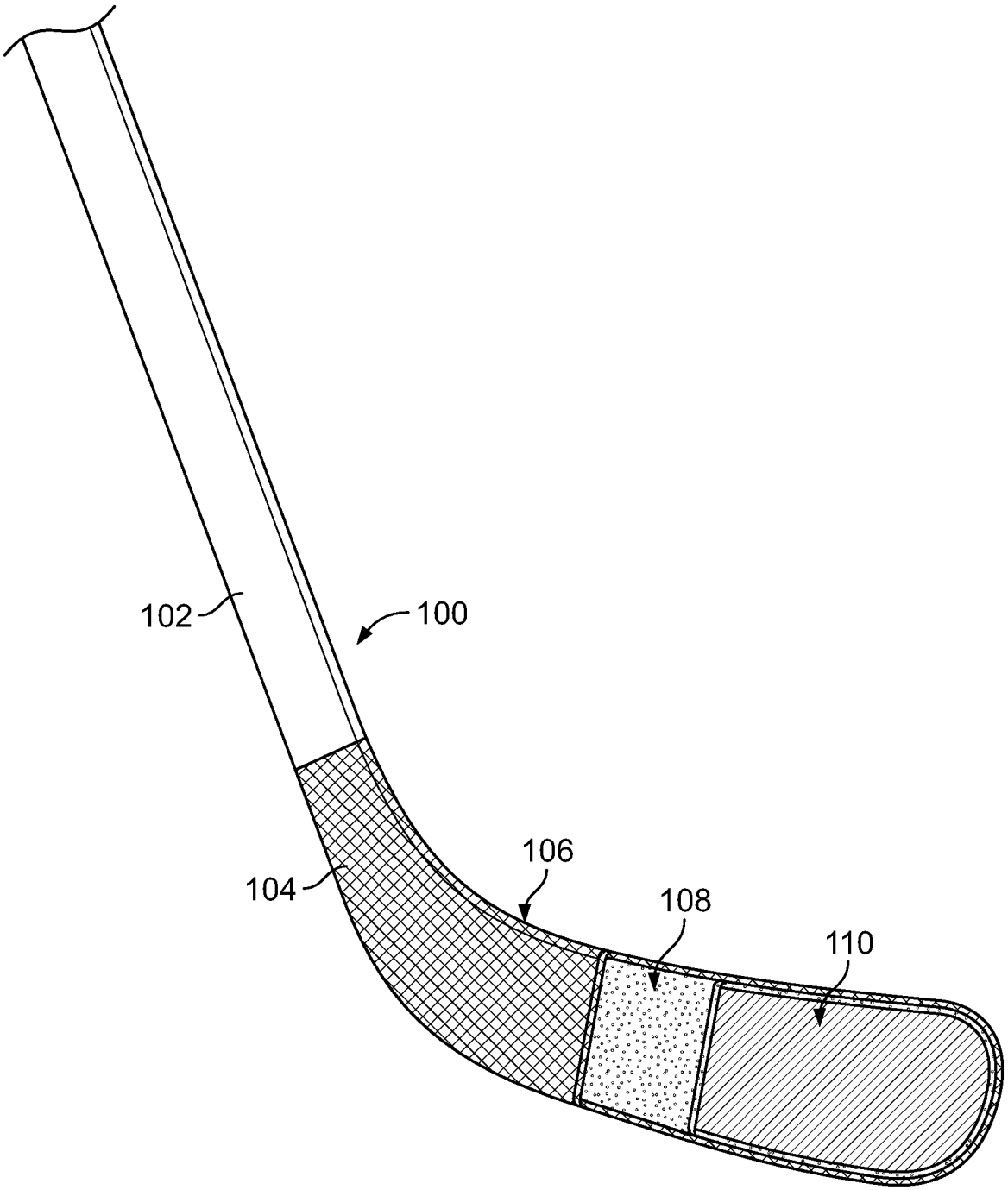
FIG. 1 generally illustrates a partial cross-section and perspective view of an example hockey stick in accordance with an aspect of the disclosure.

FIG. 1 illustrates a perspective view an example structure utilizing a recovery gel with a section of the blade 104 partially cut away. In this example, the sporting implement can be a hockey stick 100. However, it is contemplated that the repairing technique could be used in conjunction with other core structures outside of sporting implements and other types of sporting implements outside of hockey sticks, such as a lacrosse stick, bat, racquet, protective equipment, and the like. The example hockey stick 100 can include a handle or stick shaft 102 and a blade 104. In this example, the blade 104 can include an outer layer 106, a recovery gel 108, and a core 110. As discussed below, the outer layer 106 can be a skin formed of plies of carbon, which can be preimpregnated with a resin or can be formed as a dry material for use in a resin transfer molding (RTM) operation, The recovery gel 108 can form a gel skin layer over the core 110.

Figure 2A:
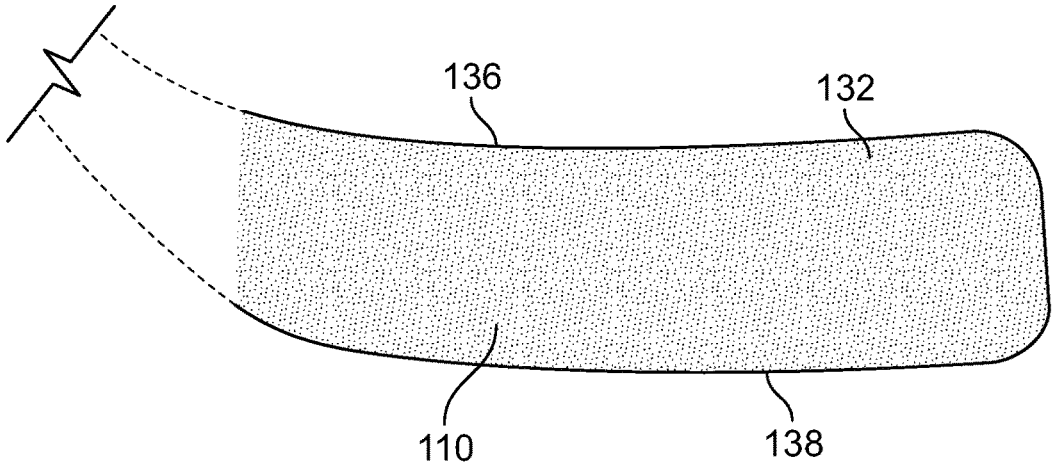
FIG. 2A shows a side view of an example core in accordance with an aspect of the disclosure.
Figure 2B:
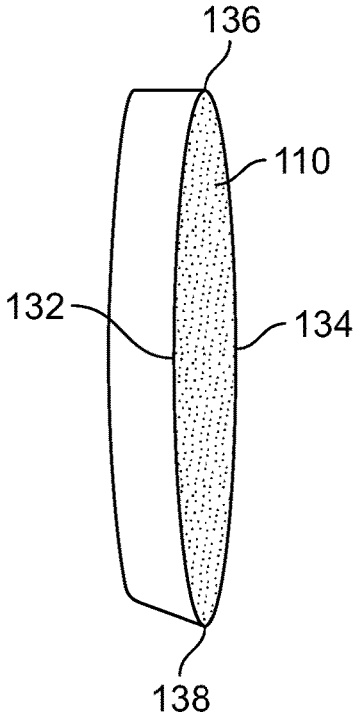
FIG. 2B shows a cross-sectional and front perspective view of the example core of FIG. 2A in accordance with an aspect of the disclosure.

FIG. 2A shows a side view of the example core 110, and FIG. 2B shows a cross-sectional view of the core 110. As discussed below, in one example, the core 110 can be formed of a suitable foam. The core 110 can include a first core face 132, a second core face 134, a top core edge 136 and a bottom core edge 138.

In certain examples, the core 110 can be an epoxy core and can be made of a B-staged epoxy resin, which can include additives and expandable microspheres. During the formation of the core, the expandable microspheres cause the core to expand when exposed to heat and create compaction force to compress plies forming the outer layer together. As will be discussed below, in one example, the epoxy core can be preformed inside a metal mold at 60° to 70° C. for 1 min so it has a shape that is close to the final geometry of the sporting implement, which in this case is a blade. An example epoxy core with expandable microspheres is discussed in U.S. Pat. No. 9,364,988, the entire contents of which are incorporated herein by reference for any and all non-limiting purposes.

In other examples, the core can be formed of a polymethacrylimide (PMI) foam such as the foam manufactured under the name Rohacell. A suitable low density PMI foam can be a RIMA (Resin Infusion Manufacturing Aid) foam. This type of foam is high strength foam that can withstand the shear and impact forces that result when a hockey blade strikes a hockey puck. An example core of this type is described in U.S. Pat. No. 9,295,890, the entire contents of which are incorporated herein by reference for any and all non-limiting purposes The recovery gel 108 can be placed on both sides, e.g. the first core face 132 and the second core face 134, of the preformed core 110 to provide a gel skin layer 108 that extends between the core 110 and the outer layer 106. In this example, the recovery gel 108 only partially covers the blade in that the gel skin layer only extends along the first core face 132 and the second core face 134. In other examples, the recovery gel 108 can be only applied to the front face, only to the back face, or only on the edges of the blade. Additionally, the recovery gel can be applied to only part of front face, part of back face, part of edges and various combinations of the above. However, in other examples, the recovery gel can form a film over the entire core of the blade including the first core face 132, the second core face 134, the top core edge 136, and the bottom core edge 138.

Figure 6A:
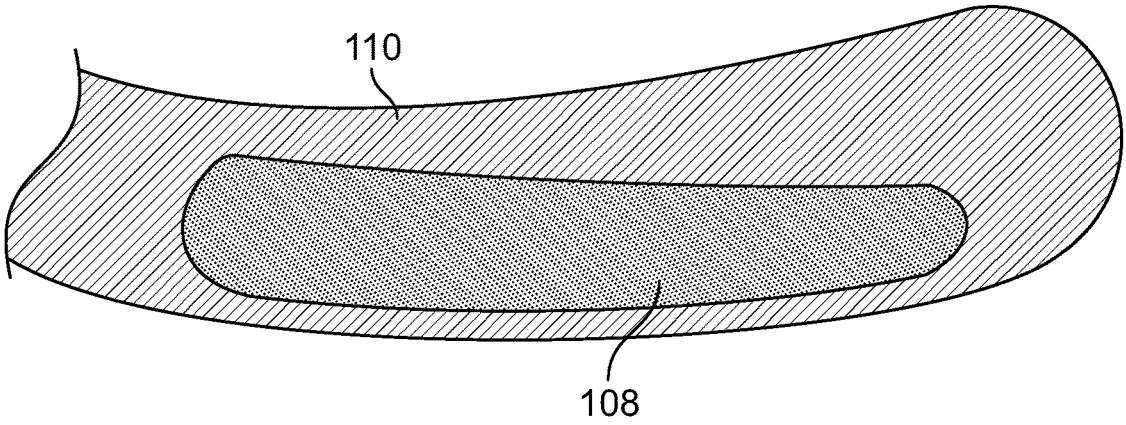
FIGS. 6A-6C show example recovery gel application patterns.
Figure 6B:
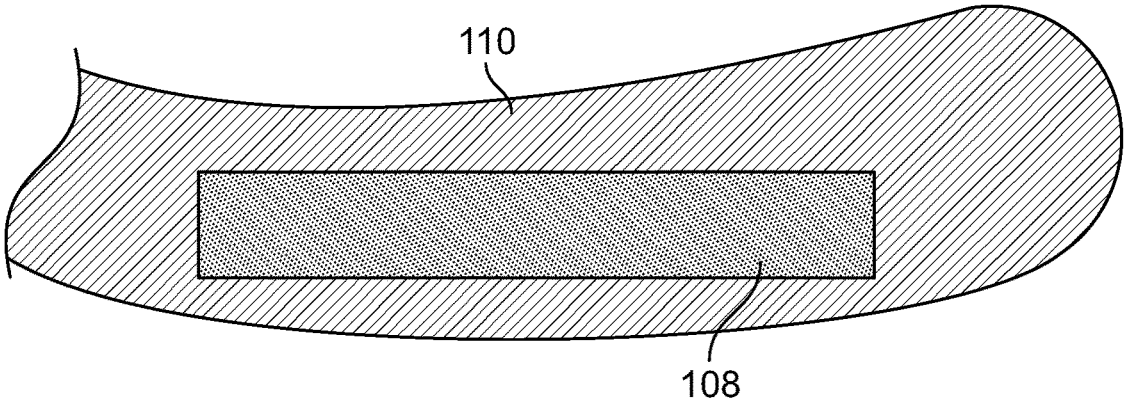
Figure 6C:
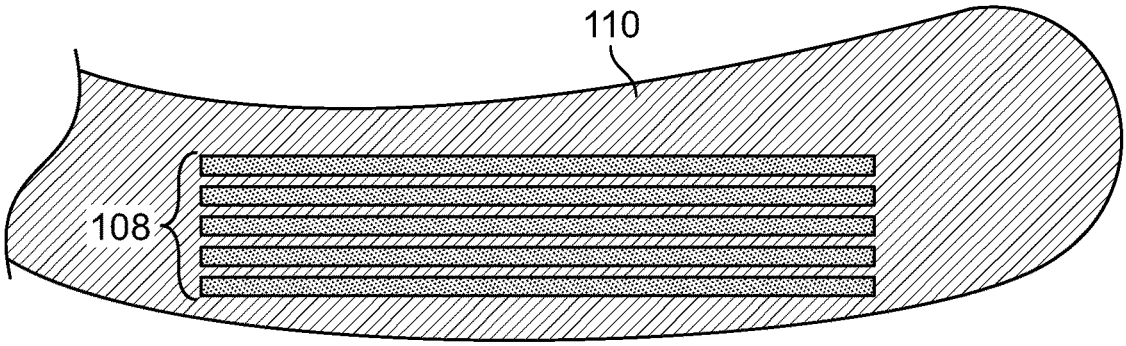
Figure 7:
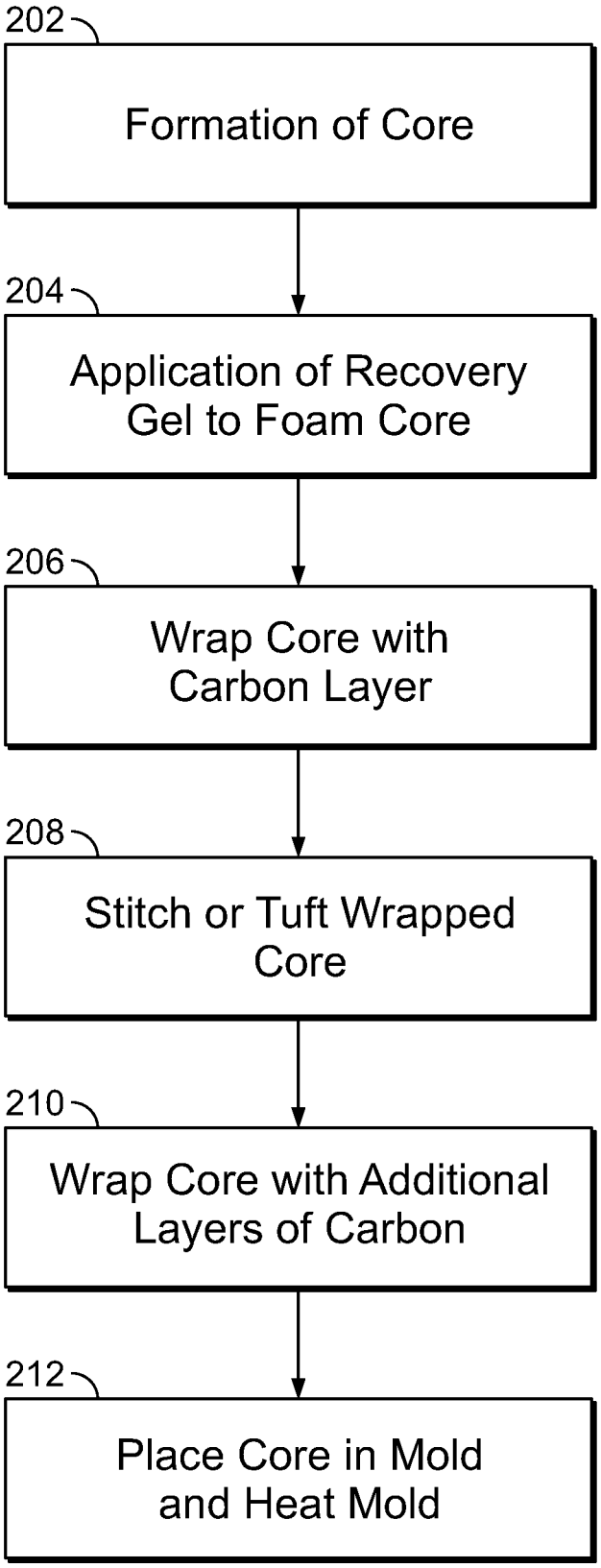
FIG. 7 shows an exemplary process for forming an example blade in accordance with an aspect of the disclosure.

FIGS. 6A-6C show different example applications of the recovery gel 108 applied to the core 110. Generally, the recovery gel 108 can be applied to sections of the core 110 where the blade encounters the most impacts. For example, in the striking region of the blade between the heel and the toe. As shown in FIG. 6A, the recovery gel 108 can be applied to the core 110 such that the recovery gel 108 tapers from the heel section to the toe section of the blade. Alternatively, as shown in FIG. 6B, the recovery gel 108 can be applied as a rectangular shape to the core 110 and extends generally in the striking region of the blade. As shown in FIG. 6C, the recovery gel 108 can be applied as small strips of material on the core 110 also in the striking region of the blade. In each of these examples, the patterns can be applied to both the front face and back face regions of the blade. In other examples, a different pattern can be applied to the front face region than the back face region of the blade.

The recovery gel 108 can be in the form of a memory shape gel such that it is shape recoverable. In this way, the recovery gel 108 offers some resistance to spreading across the surface of the core 110. If pressure is applied to the recovery gel 108, it can move and spread slightly. However, as soon as the pressure is removed, the recovery gel 108 will reform into its original shape. This allows the recovery gel 108 to remain uniform under the carbon skin during the use of the blade as impacts occur. This also allows the recovery gel to be configured to absorb energy impacts between the outer layer and the core of the blade.

The recovery gel can also be formed compressible, such that it can be pressurized to a predetermined pressure, which in one example can be up to 2 Bar. In this way, the recovery gel can be configured to provide an integrated agent for filling cracks that appear during use of the sporting implement. However, in other examples, the recovery gel can exhibit a very low pressure or no pressure at all. In one example, 5+/−1 grams of a recovery gel can be applied on each side of the core 110. However, in other examples, the amount of recovery gel can range from 2 to 15 grams.

Also, in one example, the recovery gel can be viscoelastic, which means that with a high speed rate of stress, the behavior of the recovery gel is close to a stiffer material, similar to a plastic, while if the speed rate of stress is low, the behavior is closer to a fluid similar to water. Without stickiness or tackiness, the recovery gel may slide between the layers of the blade (carbon skins and core) and may not transmit the shear stresses resulting in a soft blade.

Various methods can be used to apply the recovery gel to the core. For example, the recovery gel can be brushed onto the core or brushed onto the prepreg or outer carbon layers. In other examples, the recovery gel can be brushed over a super-thin layer of glass fiber and then applied to the core or casted in a preform and applied to the core. Also, a thickness calibrated sheet of material or gel sheet can be formed, cut, sprayed or dipped with the recovery gel and then applied to the core. The sheet of material can remain on the structure or can be peeled away to act as a release layer. In certain examples, the release layer can be adhered to a piece of the prepreg that forms the outer layer, which then is wrapped around the core. In one example, the sheet of material can be die-cut to the desired shape such that the scrap rate is low and the efficiency is higher. In yet another example, the recovery gel may also be injected at the surface of the core with a syringe.

In certain examples, a suitable material for the recovery gel 108 can be polyurethane blended with expandable microspheres. This formulation helps to ensure the cohesion of the core material of a sandwich structure by integrating a material that will fill cracks and be sticky enough to transmit stresses. In some examples, the recovery material can be a blend of three different materials. For example, the recovery gel can be polyurethane, with a mix ratio of 1:5 by weight, microspheres from Expancel and a red dye gel containing no water solvent. Other example recovery gel materials may include silicone, epoxy, polyester, vinyl-ester, rubber, gelatin, hydrogels, organogels, xerogels, or combinations thereof. The recovery gel 108 can have the consistency of a paste and can have a hardness of 20 Shore 00 value once polymerized.

In certain examples, red dye can be used to monitor and visualize the material behavior of the recovery gel inside the blade after cutting it. The red dye also helps to determine the misplacement and the degree of curing. Additionally, the dye can appear as a "blood" color to showcase a "living technology" to the end user. Without the dye, it may be more difficult to see where the recovery gel went relative to the core. For example, the red dye helps to confirm that the recovery gel did exactly what was expected during the formation of a crack. For example, a technician may see several thin red lines within the epoxy core after several impacts indicating that the recovery gel really did flow within the crack to repair the failure within the core.

Figure 3A:
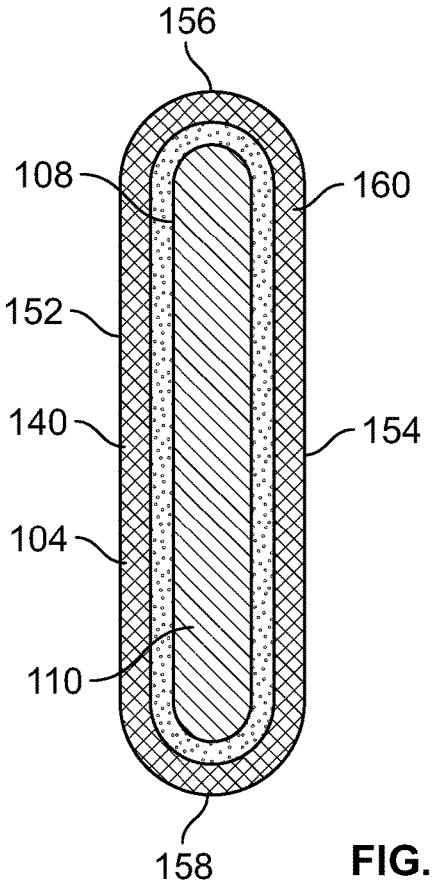
FIG. 3A shows a cross-sectional view of an example blade in accordance with an aspect of the disclosure.

The core can then be wrapped with one or more carbon layers to form the outer layer 106 of the blade. For example, as illustrated in FIG. 3, the core 110 can be wrapped with a layer of carbon tape 140 that is optionally preimpregnated with resin, resulting in a wrapped structure 160. The tape 140 can be, in one example, wrapped continuously around the first core face 132, the second core face 134, the top core edge 136 and the bottom core edge 138 of the core 110 and recovery gel 108. This continuous wrapping of the core 110 with the tape 140 results in a first wrapped face 152, a second wrapped face 154, a top wrapped edge 156 and a bottom wrapped edge 158. It is to be understood that a layer of tape or material need not consist of a single unitary piece or sheet of material. For example, a layer can consist of a combination of multiple pieces or sheets that overlap.

Once the foam core is wrapped with one or more layers of carbon tape 140, a stitching or tufting process may also be used to avoid any post-expansion of the blade during the post-curing steps. An example core and stitching process is described, for example, in U.S. Pat. No. 9,295,890, again, the entire contents of which are incorporated herein by reference for any and all non-limiting purposes. In one example, the thread (not shown) may be a high strength polyester thread that can withstand heating and maintain its physical properties at and above the temperature of the mold, which in one example can range from 135 to 165 degrees C. In other examples, the thread may also be a carbon fiber thread or a carbon fiber thread preimpregnated with resin. In certain examples, the thread can be stitched onto the tape 140 in a series of three parallel lines of stitching. In an alternative examples (not shown), eight parallel lines of thread are used. In other examples, there is no set or predetermined pattern to the thread.

The stitching or tufting process may be applied to the core after one or more of the carbon layers are applied to the blade. In one example, the foam core 110 can be wrapped with a single layer of carbon tape 140 before the stitching or tufting operation. Wrapping the core 110 with too many layers of carbon tape prior to stitching may in certain instances result in wrinkling of the tape when it is stitched or tufted. The thread can extend from the first wrapped face 152 through the core 110 to the second wrapped face 154. The thread creates the effect of an I-beam between the first wrapped face 152 and the second wrapped face 154 and adds structural and shear strength and rigidity between the faces. The thread can also pull the first wrapped face 152 and the second wrapped face 154 at the point where the thread enters the core 110. Hence, in certain examples, the wrapped, stitched core is not flat in that the result of the thread pulling the tape 140 toward the core 110 and various locations creates a somewhat bumpy or pillow effect on the surface of the first wrapped face 152 and the second wrapped face 154. However, after the application of the thread through stitching or tufting, one or more layers of carbon tape 140 can be added to the core resulting in a smooth preform.

It is also contemplated that a veil or scrim material (not shown) in the form of a thin non-tacky layer of woven fiberglass or polyester can be placed along the first wrapped face 152 and the second wrapped face 154 to allow for stitching or tufting without wrinkling the tape or causing the machinery to otherwise stick or jam. The veil is placed on the wrapped faces 152, 154 in the manner of a sandwich, with a single layer of material on each face.

Figure 3B:
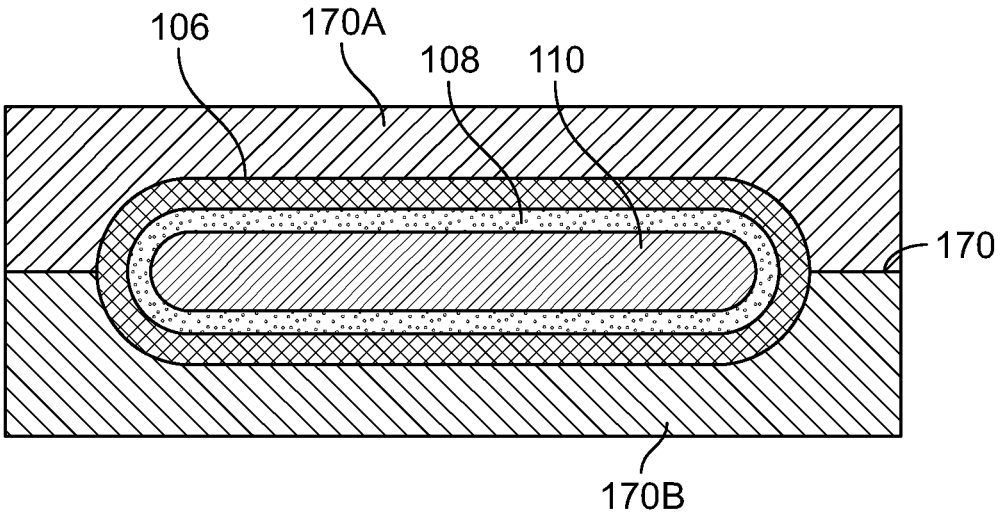
FIG. 3B shows another cross-sectional view of the example blade of FIG. 3A in a molding operation in accordance with an aspect of the disclosure.
Figure 3C:
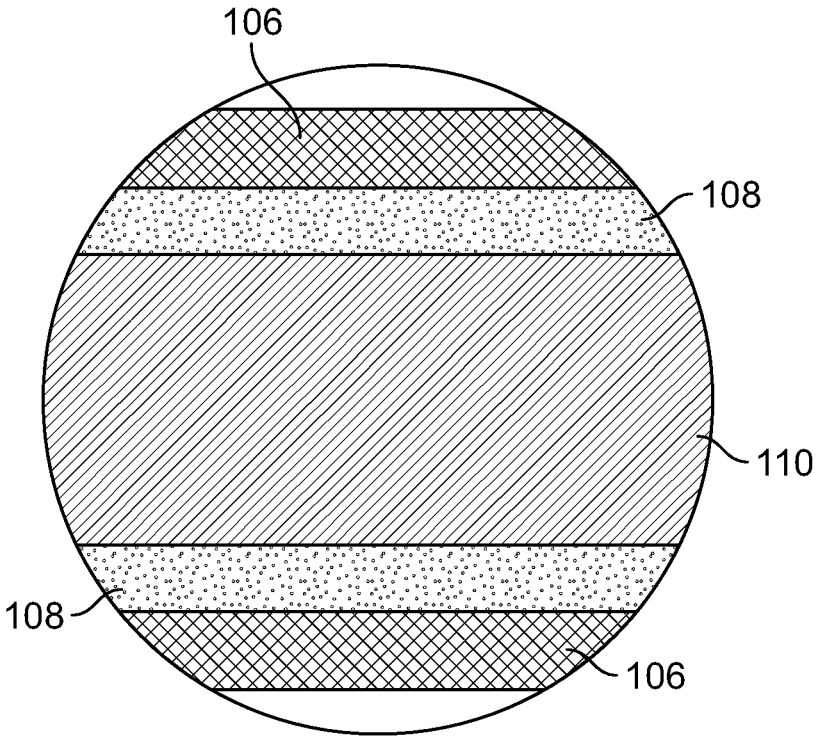
FIG. 3C shows an enlarged view of FIG. 3A in accordance with an aspect of the disclosure.

Once the carbon layers are applied onto the blade, the blade can be molded separately or together with the shaft of the stick. FIG. 3B shows a schematic of a cross-section of the preform in a mold prior to the molding operation. As shown in FIG. 3B, the blade construct can be placed into a mold 170, which can consist of a first mold half 170A and a second mold half 170B, where heat is applied to the preform. In one example, the mold 170 can formed of a suitable metal. FIG. 3C shows an enlarged view of the preform before the molding operation.

Figure 4A:
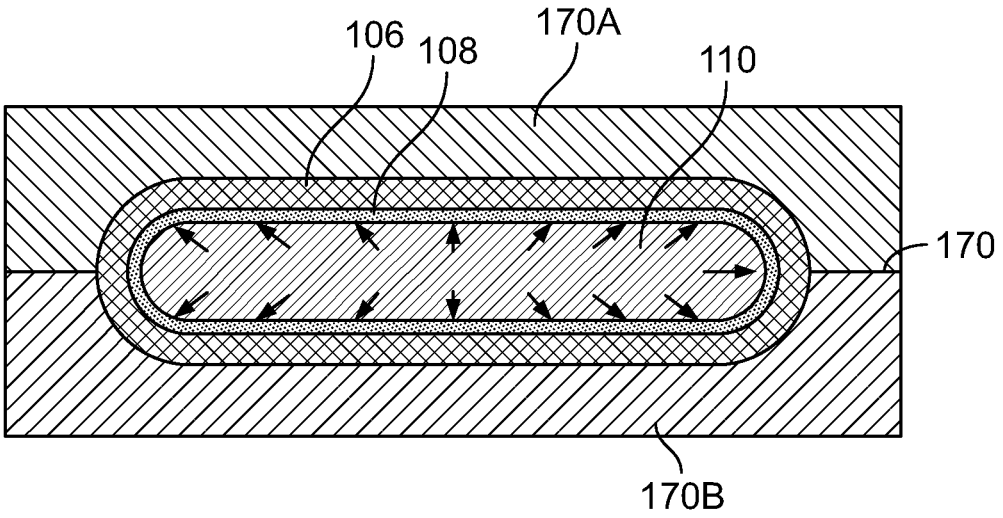
FIG. 4A shows yet another cross-sectional view of the example blade of FIG. 3A during a molding operation in accordance with an aspect of the disclosure.
Figure 4B:
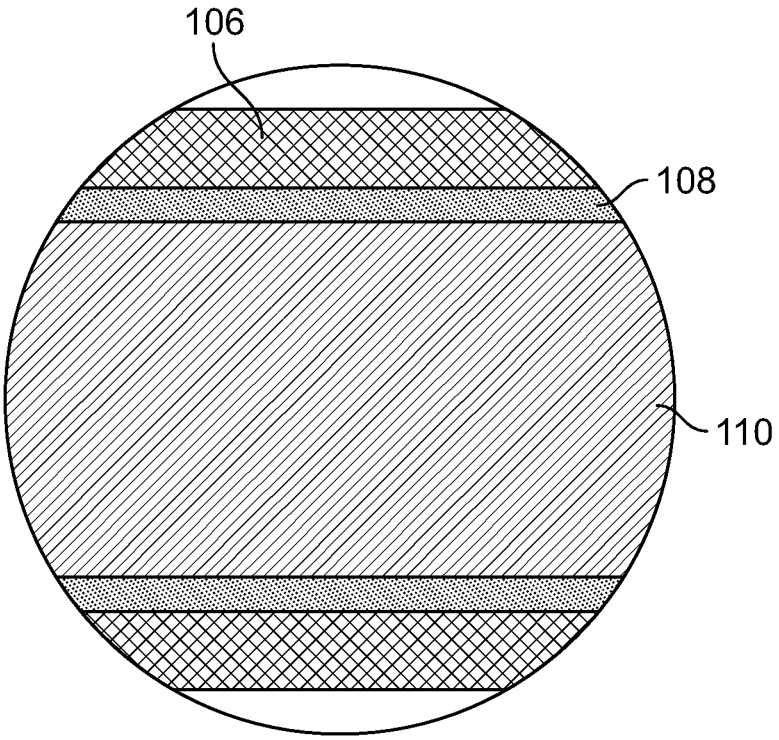
FIG. 4B shows an enlarged view of the example blade of FIG. 3A after a molding operation in accordance with an aspect of the disclosure.

As shown in FIG. 4A, heat is applied to the mold and during the molding operation, the epoxy core 110 takes expansion and pushes the recovery gel 108 and the carbon layers 106 against the mold walls, as indicated by the arrows in FIG. 4A. In one example, and as discussed herein, the carbon layers 106 can be impregnated with an epoxy resin. The epoxy resin makes the carbon layers 106 somewhat impermeable to the recovery gel 108. Thus, in certain examples, where the recovery gel 108 is a shape recovery gel, the recovery gel 108 can be compressed and be pressurized to a predetermined pressure, which in one example can be up to 2 Bar. Also during the curing of the blade, the resin impregnated in the carbon layers or plies 106 crosslinks and becomes hard, and the epoxy in the epoxy core 110 also crosslinks and becomes hard. After curing, the recovery gel 108 becomes entrapped and pressurized between the core 110 and the carbon layers 106, which shown is in the enlarged schematic of the construct in FIG. 4B. However, the pressure of the recovery gel 108 is not high enough to deform the blade when the stick is taken out of the mold due to the stiffness of the carbon fibers. Nonetheless, the pressure of the recovery gel 108 is sufficient to fill any cracks when they appear in the core or the outer layer, e.g. carbon layers 106.

During use of the blade, the recovery gel 108 also creates a soft "feel" or interface between the epoxy core 110 and the carbon layer or skin 106 that receives impacts, helping to prevent the epoxy core 110 from cracking easily due to its relative brittleness. Moreover, in using a film, the carbon skins 106 can be limited in their movement and are less likely to fail by overpassing their maximum strain. The recovery gel 108 allows the outer layer 106 to deflect a limited amount to help prevent the outer layer 106 from tearing or breaking, which could occur with a fully soft core. In one example, the deflection or movement of the carbon layer 106 is limited to 0.5-1 mm.

Figure 5A:
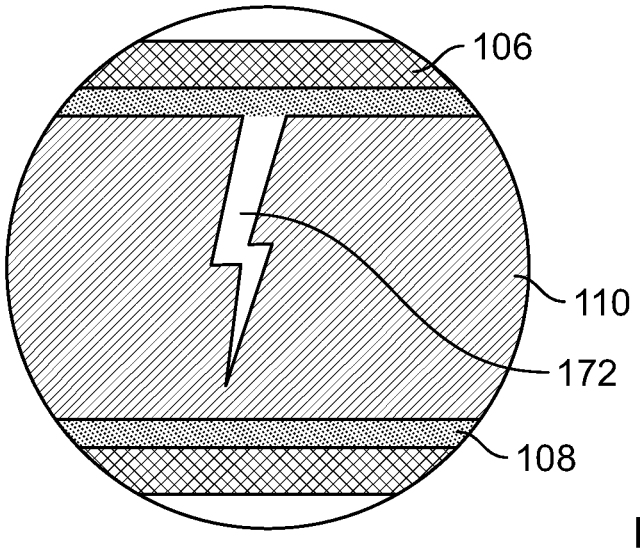
FIG. 5A shows a cross-sectional view of the example blade of FIG. 3A after a crack is formed in accordance with an aspect of the disclosure.
Figure 5B:
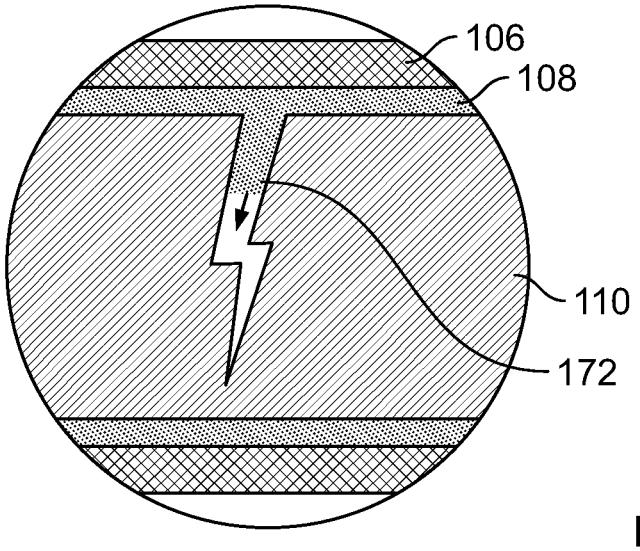
FIG. 5B shows a cross-sectional view of the example blade of FIG. 3A showing a recovery gel entering the crack is formed in FIG. 5A in accordance with an aspect of the disclosure.
Figure 5C:
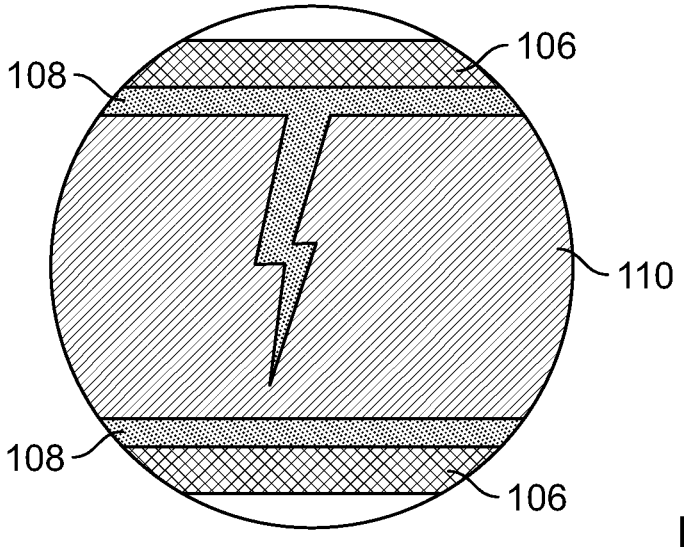
FIG. 5C shows a cross-sectional view of the example blade of FIG. 3A showing a recovery gel sealing the crack formed in FIG. 5A in accordance with an aspect of the disclosure.

Referring now to FIGS. 5A-5C if the core 110 or the outer layer 106 at the recovery gel interface cracks due to a large deformation or impact, the predetermined pressure of the recovery gel is relieved into the cracks or cavities formed by the cracks and fills into the cracks or cavity of the core. Specifically, as a crack 172 is formed in the core 110, the pressurized recovery gel 108 flows into the crack 172 as shown by the downward pointing arrow in FIG. 5B. As shown in FIG. 5C, this can provide cohesion between separated components, i.e., the outer carbon layer and the core and can recreate a new material in the place of the cracks or cavities. In essence, the recovery gel 108 recreates a new foam material where voids were created in the core 110. This allows the recovery gel 108 to help prevent cracks from propagating and to actively heal potential damages by reducing stiffness loss caused by cracks.

In certain examples, the tackiness of the recovery gel 108 can be high, meaning that there are a lot of available molecular functions available. For example, the recovery gel surface in contact with the core is very high allowing it to flow into small cracks or holes. Moreover, the recovery gel itself can include some weak links as a result of its formulation and, thus, would "prefer" to adhere with other structures, similar to polar molecules of a degreasing agent. This allows the recovery gel 108 to adhere to any cracks and, thus, creates a new bond between each side of the crack. Also, where expandable microspheres are used in the recovery gel, the expandable microspheres are useful in filling any major cracks when they occur.

Additionally, if it becomes apparent that a crack has formed in the blade meaning the core is broken, for example, if the user hears a sound during use of the blade, the stick can be placed into an oven at 135° C. for 3 to 5 minutes. This can be useful in instances where it is apparent that the recovery gel has not filled the space of the crack formed in the blade or where the entire pressure of the recovery gel has already been relieved by a large amount of cracks in the core. The heat applied to the blade can in certain examples allow the recovery gel to expand and fill in any major cracks in the core. The tackiness of the gel after curing the blade in the oven may be slightly lower but will still be present should additional cracks form in the core. In addition, when the recovery gel 108 cures in a crack, the texture of the recovery gel changes to be more consistent with the texture of a foam material so that the feel of the sporting implement or hockey stick does not change significantly. The expandable microspheres inside the gel can expand as the gel fills into cracks in the core. The cracks create room for the gas in the expandable microspheres to expand. As the gel expands, the density can become lower (same weight but bigger volume). The overall material of the blade can feel and behave more like a foam material than the previous form of the recovery gel because the gas of the expanded microspheres is released resulting in a material closer to foam. However, the properties of the recovery gel remaining between the core and the outer layer will not change significantly including its texture.

In other examples, the core of the blade can be manufactured by forming a construct of multiple cores or foams. Different combinations of core materials are used to create distinct recipes of core mixtures. The different mixtures can be used to create a blade with zones of varying density and stiffness. Core mixtures with higher density materials can be placed in the areas of the blade subject to greater forces and impacts, such as the bottom or heel, to create stronger blade regions. For instance, the bottom of the blade and the heel of the blade are typically subject to the most force and impact from striking the ice or a hockey puck. For example, the different cores can be placed on various locations of the blade to create a blade with zones of varying density, such as the top or the toe of the blade to reduce weight. Higher density foam can be placed along the bottom of the blade where the blade is subjected to high impacts and lower density foam can be placed at an upper portion of the blade where the blade is subject to fewer impacts. One such example core is discussed in U.S. Pat. No. 9,289,662, the entire contents of which are incorporated herein by reference for any and all non-limiting purposes. Where different cores or foams are used the core could be provided with more than one type of recovery gel such that each core or foam is provided with a specific recovery gel that is most suitable for filing cracks that form in the particular core or foam. For example, recovery gels could be placed inside carbon compartments to divide the recovery gels across the blade. Also, the recovery gels could potentially have a different absorption or feel across the length of the blade to provide different properties when cracks form.

An example process of manufacturing a blade in accordance with the disclosure is illustrated in FIG. 6. First a foam core is formed as shown at step 202. Next a recovery gel can be added to the foam core at 204 such that it is applied to each face of the core or such that the recovery gel extends around the foam core entirely. For example, multiple sheets of material containing the recovery gel can be formed, weighed, and cut. The sheets of material, which can be small inserts or parts, are then adhered on the desired portions of the core. In other examples, as discussed above, the recovery gel can be brushed onto the core, brushed onto the outer layer, or injected. In other examples, the recovery gel can be brushed over a super-thin layer of glass fiber and then applied to the core or casted in a preform and applied to the core.

The foam core is then wrapped with a first layer or layers of carbon or fiber tape as shown at 206. The first layer of carbon or fiber tape extends continuously along the first core face, top core edge, second core face and bottom core edge of the foam core, such that the wrapped core has a first wrapped face, a second wrapped face, a top wrapped edge and a bottom wrapped edge. Optionally, a non-sticky veil can be applied to the first wrapped face and second wrapped face to assist with a stitching or tufting process. The wrapped foam core can then be stitched or tufted with a thread as shown at 208. The thread extends between and along the first wrapped face and the second wrapped face. The stitched wrapped core may be wrapped with a second layer or layers of fiber tape to form a wrapped preform, as shown at 210. The second layer of fiber tape extends continuously atop the first layer of fiber tape and along the first wrapped face, the top wrapped edge, the second wrapped face, and the bottom wrapped edge.

The wrapped preform is then placed in a mold, as shown at 212, and the mold is heated to an appropriate temperature. In one example, the mold is heated to between 135 to 165 degrees C., and in one particular example, the mold can be heated to 160 degrees C. The heating causes the recovery gel to become pressurized between the core and the layers of fiber tape. The resin in the preimpregnated tape melts, flows through the woven veil, if used, crosslinks and bonds the layers of fiber tape together. When the recovery gel is applied it can be placed to avoid direct contact between the layers of carbon and the core. When recovery gel inserts are used, contact between the layers of carbon and the core is avoided in the location of the insert but the remainder of the layers of carbon and the core of the blade are in direct contact. However, if the core is entirely covered with the recovery gel around the core, no bonding will occur between the epoxy core and the carbon prepreg layers. In one example, the recovery gel that is applied to the core before molding can be already polymerized at 100% and, thus, during formation does not crosslink to the layers of carbon and core.

Additionally, when the mold is heated, the resin in the preimpregnated tape can flow along the threads and into the core. When this resin cools, it creates additional strength in the z-axis of the structure. Carbon fiber thread, which may be used in one example, shrinks when it is heated. Carbon fiber thread results in a more homogenous structure because the carbon fiber thread shares properties with the carbon fiber tape. The thread can also create a stiffening agent that gives additional resistance against shearing. The mold is then cooled, and the formed structure is removed from the mold.

It is also contemplated that the blade could be formed using a resin transfer molding (RTM) process. In such a case, the recovery gel can be encapsulated between the core and the outer layer. However, the recovery gel would not be configured to flow into a crack or tear in the core during use of the blade. Nevertheless, if a crack is formed in the core of an RTM formed blade, heating the blade will force the microspheres to expand and, thus, fill the crack. Therefore, a blade formed by RTM can be configured to be healable by heating the core or by "thermal-healing" the core.

In one example, a sporting implement can include a recovery gel, which can be a memory shape gel. The recovery gel can form a film within the sporting implement. The recovery gel can be compressible, shape recoverable, and pressurized to a predetermined pressure so as to provide an integrated agent for filling cracks that appear during use of the sporting implement. The sporting may include an outer layer and a core, and the recovery gel can be configured to absorb energy impacts between the outer layer and the core. The core can be formed of an epoxy, and the outer layer may include a carbon skin to form a blade for a hockey stick. The recovery gel may allow the outer layer to deflect no more than 0.5 to 1 mm and to help prevent the outer layer from tearing or breaking. When a crack appears, the predetermined pressure can be relieved inside the crack and fill a cavity formed by the crack to provide cohesion between separated components to recreate a new material in the place of the crack. In one example, the predetermined pressure can be 0 to 2 Bar. The recovery gel can be configured to help prevent cracks from propagating and actively heals potential damages by reducing stiffness loss caused by cracks. The recovery gel can include a polyurethane blended with expandable microspheres.

In another example, a blade for a hockey stick may include an outer layer, a core, and a recovery gel positioned between the core and the outer layer. The recovery gel can form a film, and the recovery gel can be compressible, shape recoverable, and pressurized to a predetermined pressure and configured to provide an integrated agent for filling cracks that appear during use of the blade. The recovery gel can be configured to absorb energy impacts between the outer layer and the core. The recovery gel can partially cover a surface of the core, or alternatively, the recovery gel can cover an entire surface of the core.

Also the core can be formed of an epoxy, and the outer layer may include a carbon skin. The recovery gel can allow the outer layer to deflect no more than 0.5 to 1 mm and to help prevent the outer layer from tearing or breaking. When a crack appears, the predetermined pressure can be relieved inside the crack and fills a cavity formed by the crack to provide a cohesion between the outer layer and the core to recreate a new material in the place of the crack. In one example, the predetermined pressure is 0 to 2 Bar. The recovery gel can be configured to help prevent cracks from propagating and actively heals potential damages by reducing stiffness loss caused by cracks. The recovery gel can include a polyurethane blended with expandable microspheres.

In yet another example, a method of actively healing a blade for a hockey stick may include forming an outer layer, forming a core, and placing a recovery gel between the core and the outer layer. In one example, the recovery gel can form a film. The method may also include configuring the recovery gel to be compressible, and shape recoverable and pressurizing the recovery gel to a predetermined pressure to provide an integrated agent for filling cracks that appear during use of the blade. The method may also include configuring the recovery gel to absorb energy impacts between the outer layer and the core, forming the core of an epoxy and forming the outer layer of a carbon skin and configuring the recovery gel to allow the outer layer to deflect no more than 0.5 to 1 mm and to help prevent the outer layer from tearing or breaking. Additionally the method may include configuring the predetermined pressure of recovery gel to be relieved inside a crack to fill a cavity formed by the crack to provide a cohesion between the outer layer and the core to recreate a new material in the place of the crack, setting the predetermined pressure to 0 to 2 Bar, configuring the recovery gel to help prevent cracks from propagating and to actively heal potential damages by reducing stiffness loss caused by cracks, forming the recovery gel of a polyurethane blended with expandable microspheres, and heating the blade at 135° C. for 3 to 5 minutes to help fill cracks.

The reader should understand that these specific examples are set forth merely to illustrate examples of the disclosure, and they should not be construed as limiting this disclosure. Many variations in the connection system may be made from the specific structures described above without departing from this disclosure.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A method of actively healing a blade for a hockey stick comprising:

forming an outer layer;

forming a core;

placing a recovery gel between the core and the outer layer, the recovery gel forming a film;

configuring the recovery gel to be compressible, and shape recoverable; and pressurizing, before any cracks appear in the blade, the recovery gel to a predetermined absolute pressure that is above atmospheric pressure to provide an integrated agent for filling cracks in a carbon fiber material of the blade that appear during use of the blade, wherein the recovery gel is integrated into the blade during fabrication and before any cracks appear in the stick, and wherein the predetermined absolute pressure that is above atmospheric pressure of the recovery gel is relieved as a result of the recovery gel flowing in to fill cracks that appear during use of the blade without requiring any externally applied material.

2. The method of claim 1 further comprising configuring the recovery gel to absorb energy impacts between the outer layer and the core.

3. The method of claim 1 further comprising forming the core of an epoxy and forming the outer layer of a carbon skin.

4. The method of claim 1 further comprising configuring the recovery gel to allow the outer layer to deflect no more than 0.5 to 1 mm and to help prevent the outer layer from tearing or breaking.

5. The method of claim 1, wherein the recovery gel provides cohesion between the outer layer and the core to recreate a new material in place of the crack.

6. The method of claim 1 further comprising setting the predetermined pressure to 0.1 to 2 Bar gauge pressure above atmospheric pressure.

7. The method of claim 1 further comprising configuring the recovery gel to help prevent cracks from propagating and to actively heal potential damages by reducing stiffness loss caused by cracks.

8. The method of claim 1 further comprising forming the recovery gel of polyurethane blended with expandable microspheres.

9. The method of claim 1 further comprising heating the blade at 135° C. for 3 to 5 minutes to help fill the cracks in the core.

* * * * *